United States Patent [19]

Hosokawa et al.

[11] 4,292,172

[45] Sep. 29, 1981

[54] APPARATUS FOR CLASSIFYING PARTICLES

[75] Inventors: Masuo Hosokawa, Toyonaka; Tohei Yokoyama, Kyoto; Noriyoshi Kaya, Hirakata all of Japan

[73] Assignee: Kabushiki Kaisha Hosokawa Funtai Kogaku Kenkyusho, Osaka, Japan

[21] Appl. No.: 140,508

[22] Filed: Apr. 15, 1980

[30] Foreign Application Priority Data

May 28, 1979 [JP] Japan ..... 54/65808

[51] Int. Cl.[3] ..... B07B 7/083

[52] U.S. Cl. ..... 209/144

[58] Field of Search ..... 209/1, 144, 211; 210/512 R, 512 M; 55/400

[56] References Cited

U.S. PATENT DOCUMENTS

| | | | |
|---|---|---|---|
| 2,973,861 | 3/1961 | Jager | 209/1 |
| 3,494,217 | 2/1970 | Tanaka et al. | 209/1 X |
| 3,670,886 | 6/1972 | Hosokawa et al. | 209/144 X |
| 3,734,287 | 5/1973 | Jager | 209/144 X |

*Primary Examiner*—William A. Cuchlinski, Jr.
*Attorney, Agent, or Firm*—Edwin E. Greigg

[57] ABSTRACT

An apparatus for classifying particles into fine particles and coarse particles by a classification standard particle size which is determined by selecting a rotational frequency of a classifying rotor. The rotational frequency is derived from an equation stored in a computer and the rotor is automatically maintained at the rotational frequency thus derived.

3 Claims, 5 Drawing Figures

APPARATUS FOR CLASSIFYING PARTICLES

BACKGROUND OF THE INVENTION

The present invention relates to apparatus for classifying particles comprising a housing defining a classifying chamber, a feed duct for feeding particles to be treated and a feed duct for feeding classifying gas, both connected to the housing, a suction duct connected to the housing for transmitting gasborne fine particles resulting from a classifying operation, gas flow rate in the suction duct being maintained substantially constant, a discharge duct connected to the housing for discharging coarse particles resulting from the classifying operation, and a classifying rotor mounted in the housing and adapted to rotate at varied frequencies to select a classification standard particle size.

This type of classifying apparatus applies to the particles a floating force by the classifying gas and a centrifugal force by the classifying rotor at the same time, and discharges gasborne fine particles through the suction duct and coarse particles through the discharge duct. The classification standard particle size is changed or determined by changing the rotational frequency of the classifying rotor. Conventionally, this rotational frequency is changed manually, and therefore it is difficult to change, set and then maintain the rotational frequency, which makes it extremely difficult to carry out a desired classifying treatment.

SUMMARY OF THE INVENTION

This invention intends to eliminate the above noted disadvantage of conventional apparatus and provides an apparatus comprising a computer storing an equation, $$N = K \cdot \frac{1}{d} \cdot \sqrt{\frac{Q}{\rho s}}$$

; where K is a constant, for calculating a rotational frequency N of the classifying rotor from the classification standard particle size d, density $\rho s$ of the particles to be treated, and the gas flow rate Q in the suction duct, the computer including at least an input unit for establishing the classification standard particle size d, and a unit for automatically adjusting speed of the classifying rotor to the rotational frequency N derived from an input data of the classification standard particle side d and the equation.

The provision of the above computer makes it possible to derive a rotational frequency N of the rotor necessary for classification by a desired classification standard particle size d and, when necessary, gas flow rate Q and density $\rho s$ of the particles. These data are established easily and promptly and without errors, the selected rotational frequency N of the rotor is positively maintained without requiring control by an attendant, and on the whole accurate classification treatment is carried out easily and reliably.

Furthermore, as seen from the foregoing equation, classification by a desired classification particle size d is possible by controlling the gas flow rate Q in the suction duct. However, by employing the method of controlling the rotational frequency of the classifying rotor, the classification standard particle size d can be selected from a wider range and maintained more accurately.

Other objects and advantages of the invention will be apparent from the following description.

BRIEF DESCRIPTION OF THE DRAWINGS

In the drawings illustrating an apparatus for classifying particles according to this invention.

DETAILED DESCRIPTION OF THE PREFERRED EMBODIMENTS

Figure 1:
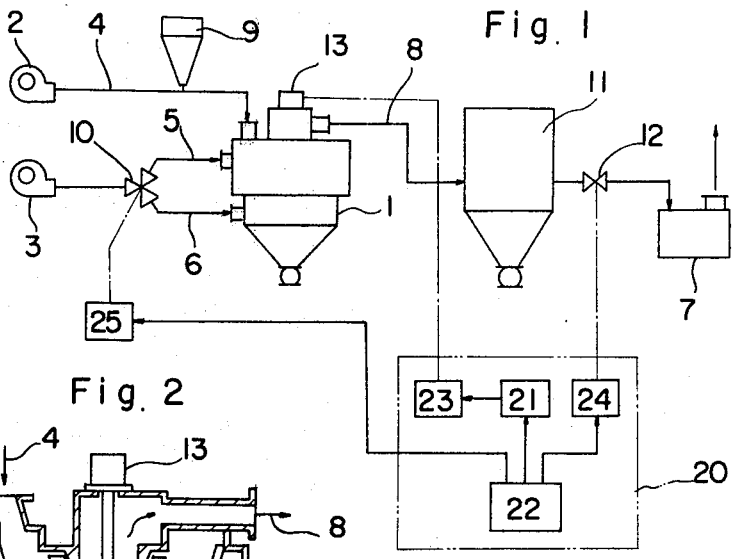
FIG. 1 is a flow sheet.

As shown in FIG. 1, a housing 1 defining a classifying chamber has in communication therewith first to third gas feed ducts 4, 5, 6 connected to respective fans 2, 3, and a suction duct 8 connected to a suction fan 7. The first gas feed duct 4 has a feeder 9 attached thereto which dispenses particulate material at a constant rate which may be determined as desired. Thus the particulate material is carried by gas and floatingly fed to the housing 1. A ratio control valve 10 is mounted where the second and third gas feed ducts 5, 6 branch off, to vary the gas flow ratio between the two ducts 5, 6 without substantially varying the total gas flow therein. The suction duct 8 is provided with a gas/solid separator 11 and a total gas flow control valve 12 to adjust the amount of gas fed to and discharged from the housing 1 and to collect classified fine particles as carried by the gas along the suction duct 8.

Figure 2:
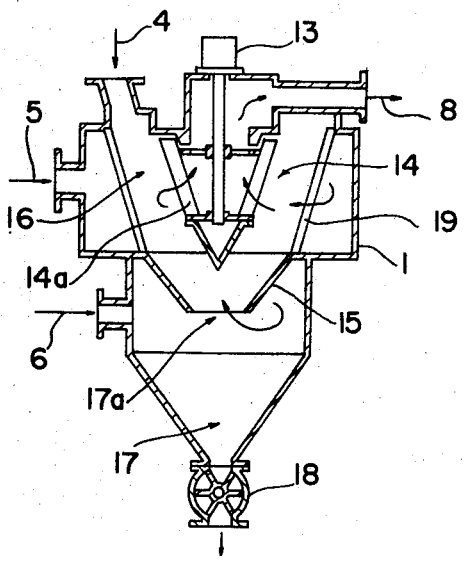
FIG. 2 is a view in vertical section showing a principal part of the apparatus.
Figure 3:
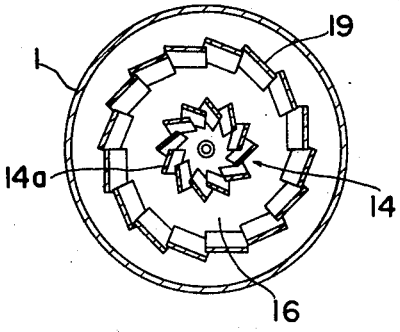
FIG. 3 is a cross section of the principal part.

As shown in FIGS. 2 and 3, the housing 1 contains a classifying rotor 14 driven by a variable speed drive 13 to rotate about a substantially vertical axis, and a downwardly tapering tubular partition 15 disposed substantially concentrically with the rotor 14, thereby forming a classifying chamber 16 communicating with the first gas feed duct 4, and a coarse particle discharge duct 17 which extends downwardly from the classifying chamber 16. The discharge duct 17 has a rotary valve 18 to permit exit of coarse particles from the housing 1 while preventing entry of ambient air. Multiple guide vanes 19 are arranged annularly about the entire circumference of the classifying chamber 16 to introduce the gas from the second gas feed duct 5 into the classifying chamber 16 such that the gas maintains particulate material dispersed and afloat and promotes swirling flows caused by the rotor 14. The third gas feed duct 6 communicates below the partition 15 to produce rising gas flows at a duct portion 17*a* where coarse particles descend in flotation, to screen out fine particles present among the coarse particles and carry them back to the classifying chamber 16. The suction duct 8 communicates with the interior of the classifying rotor 14 so that fine particles and gas that pass through the vanes 14*a* of the classifying rotor 14 are drawn into the suction duct 8.

A computer 20 is provided to control the rotational frequency N of the classifying rotor 14 and the degree of opening of the valve 12 on the suction duct 8. The computer 20 comprises an arithmetic unit 21 storing the equation, $$N = K \cdot \frac{1}{d} \cdot \sqrt{\frac{Q}{\rho s}}$$

; where K is a constant, for calculating the rotational frequency N of the classifying rotor 14 from a classification standard particle size d, the density $\rho s$ of the particles to be treated, and a gas flow rate Q in the suction duct; an input unit 22 for feeding the standard particle size d, the gas flow rate Q and particle density $\rho s$ to the arithmetic unit 21; a unit 23 for automatically adjusting the speed of the drive 13 to the rotational frequency N of the classifying rotor 14 at a value calculated by the arithmetic unit 21; and a unit 24 for automatically controlling the valve 12 to maintain the gas flow rate Q set by the input unit 22.

An operating unit 25 for the ratio control valve 10 is coupled to the input unit 22, and by using the input unit 22 the operator can set a desired gas flow ratio between the second and third gas feed ducts 5, 6.

How to use the described classifying apparatus and how it functions are described next.

Figure 4:
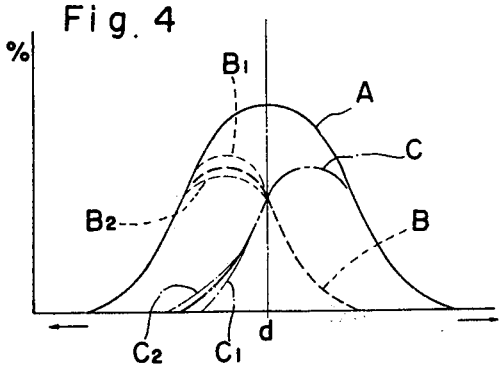
FIG. 4 is a graph showing particle size distribution.

The operator feeds to the input unit 22 signals indicating the desired classification standard particle size d, the density $\rho s$ of the particles to be treated, and the flow rate Q of gas entering the suction duct 8 suited to the capacity of the suction fan 7. Through this procedure alone, the rotational frequency N of the classifying rotor 14 and the degree of opening of the valve 12 are automatically maintained at proper values to assure a desired classification of particles of varied densities. It is now assumed that when particles having the size distribution indicated by a solid line A in FIG. 4 are classified by a standard particle size d under certain conditions, the resulting fine particles have a size distribution indicated by a dot line B and the coarse particles have a size distribution indicated by a dot-and-dash line C. If the ratio control valve 10 is then operated to pass an increased gas flow through the third gas feed duct 6, the dot line B and the dot-and-dash line C will partially change to a dot line $B_1$ and a dot-and-dash line $C_1$ respectively. If the gas flow through the duct 6 is reduced, the dot line B and the dot-and-dash line C will partially change to a dot line $B_2$ and a dot-and-dash line $C_2$ respectively. In this way, the ratio control valve 10, when operated, varies the particle size distributions of the fine or coarse particles as desired.

Figure 5:
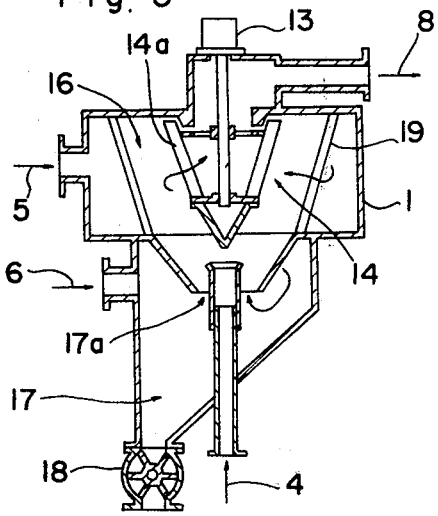
FIG. 5 is a vertical section showing a principal part of a further embodiment.

The first gas feed duct 4 may be placed in communication with the classifying chamber 16 as shown in FIG. 5 to supply particulate material and gas to rise from under the classifying rotor 14. The embodiment of FIG. 5 is different from the embodiment of FIG. 1 only in the position of the first gas feed duct 4, and the other constituent members are affixed with like numerals and are not described here. The particulate material may be fed direct to the classifying chamber 16 without being carried by gas, in which case only the second gas feed duct 5 will be sufficient. Where the particulate material is carried by gas into the classifying chamber 16, only the first gas feed duct 4 will be sufficient. In other words, it is in accordance with this invention to provide one or more feed ducts 4, 5 connected to the housing 1 to feed particulate material to be treated and classifying gas to the classifying chamber 16.

The housing 1 may have only the classifying chamber 16 provided with the classifying rotor 14, and the discharge duct 17 and the like may comprise external piping, for example.

The rotational frequency N of the classifying rotor 14 may be changed, for example, by any of various speed-change means provided between a constant speed drive 13 and the classifying rotor 14.

The valve 12 of the suction duct 8 may be dispensed with or may comprise a fixed throttle valve; it meets the requirement if the rate of gas Q flowing into the suction duct 8 is maintained substantially constant.

The signals to be fed to the computer 20 for the calculation of the rotational frequency N of the classifying rotor 14 may be limited to one indicating the classification standard particle size d, or may be those indicating the standard particle size d and the rate of gas flow Q in the suction duct 8. In the former case, the equation to be stored in the computer 20 is: $N = Ka \cdot 1/d$ where Ka is a constant. In the latter case, the equation to be stored is:

$$N = K \cdot \frac{1}{d} \cdot \sqrt{\frac{Q}{Kb}}$$

where K and Kb are constants. Thus the equation to be stored in the computer 20 is variously changeable. While microcomputer is satisfactorily serviceable as the computer 20, such a computer can be modified variously in construction.

We claim:

1. An apparatus for classifying particles comprising, a housing (1) defining a classifying chamber (16), a feed duct (4) for feeding particles to be treated and a feed duct (5) for feeding classifying gas, both connected to said housing (1), a suction duct (8) connected to said housing (1) for transmitting gasborne fine particles resulting from a classifying operation, gas flow rate (Q) in said suction duct (8) being maintained substantially constant, a discharge duct (17) connected to said housing (1) for discharging coarse particles resulting from the classifying operation, a classifying rotor (14) mounted in said housing (1) and adapted to rotate at varied frequencies to select a classification standard particle size (d), a computer (20) storing an equation, $$N = K \cdot \frac{1}{d} \cdot \sqrt{\frac{Q}{\rho s}}$$

; where K is a constant, for calculating a rotational frequency (N) of said classifying rotor (14) from the classification standard particle size (d), density ($\rho s$) of the particles to be treated, and said gas flow rate (Q) in the suction duct (8), said computer (20) including at least an input unit (22) for establishing said classification standard particle size (d), and a unit (23) for automatically adjusting speed of said classifying rotor (14) to the rotational frequency (N) derived from an input data of the classification standard particle size (d) and said equation.

2. A classifying apparatus as claimed in claim 1 wherein valve means (12) controls said gas flow rate (Q) in said suction duct (8), said input unit (22) for determining said gas flow rate (Q) and a unit (24) adapted to respond to said input unit (22) and control said valve means (12) to maintain the gas flow rate (Q) at a selected value.

3. A classifying apparatus as claimed in claim 1 or 2 wherein said input unit (22) determines said density ($\rho s$) of the particles to be treated.

* * * * *